US008534248B2

(12) United States Patent
Weber

(10) Patent No.: US 8,534,248 B2
(45) Date of Patent: Sep. 17, 2013

(54) CAMSHAFT ADJUSTER HAVING A PRESSURE ACCUMULATOR

(75) Inventor: Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/368,418

(22) Filed: Feb. 8, 2012

(65) Prior Publication Data

US 2012/0204822 A1 Aug. 16, 2012

(30) Foreign Application Priority Data

Feb. 11, 2011 (DE) ..... 10 2011 003 991

(51) Int. Cl.
*F01L 1/34* (2006.01)

(52) U.S. Cl.
USPC ..... 123/90.17; 123/90.12

(58) Field of Classification Search
USPC ..... 123/90.12, 90.15, 90.17; 464/160, 464/161
See application file for complete search history.

(56) References Cited

U.S. PATENT DOCUMENTS

| | | | | |
|---|---|---|---|---|
| 2003/0221646 | A1* | 12/2003 | Nakajima et al. | 123/90.17 |
| 2005/0274344 | A1* | 12/2005 | Auchter et al. | 123/90.17 |
| 2007/0245991 | A1* | 10/2007 | Weber | 123/90.17 |

FOREIGN PATENT DOCUMENTS

| | | | |
|---|---|---|---|
| DE | 3929621 | A1 | 3/1991 |
| DE | 195 29 277 | A1 | 2/1997 |
| DE | 10 2009 034 804 | A1 | 1/2011 |
| DE | 10 2009 035 815 | A1 | 2/2011 |
| EP | 0806550 | A1 | 11/1997 |
| EP | 2267282 | A1 | 12/2010 |
| WO | 2008140897 | A1 | 11/2008 |

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

A camshaft adjuster arrangement, which has a stator, a rotor, and a pressure accumulator, which is controlled by control vanes.

9 Claims, 9 Drawing Sheets

(I-I)

Fig. 5 (III-III)

CAMSHAFT ADJUSTER HAVING A PRESSURE ACCUMULATOR

CROSS-REFERENCE TO RELATED APPLICATION

This application claims the priority of DE 10 2011 003 991.0 filed Feb. 11, 2011, which is incorporated by reference herein.

FIELD OF THE INVENTION

The invention relates to a camshaft adjuster having a pressure accumulator.

BACKGROUND OF THE INVENTION

Camshaft adjusters are used in internal combustion engines to vary the timing of the combustion chamber valves. Adapting the timing to the current load reduces consumption and emissions. A camshaft adjuster is generally secured for conjoint rotation on a camshaft of the internal combustion engine and is in drive connection with a crankshaft. This drive connection can be implemented as a belt, chain or gear drive, for example, by means of a hydraulic phase adjustment device of the camshaft adjuster where it is possible to vary a phase relation between the crankshaft and the camshaft in a specific way by supplying or discharging pressure medium.

One widely used type of camshaft adjuster is the vane cell adjuster. Vane cell adjusters have a stator, a rotor and a drive wheel. The rotor is generally connected to the camshaft for conjoint rotation. The stator and the drive wheel are likewise connected to each other with the rotor being coaxial with the stator and within the stator. With their vanes, the rotor and the stator define oppositely acting oil chambers which can be supplied with oil pressure and enable a relative movement between the stator and the rotor. Moreover, the vane cell adjusters have various sealing covers. The assembly, which comprises the stator, the drive wheel and the sealing covers is formed by means of a plurality of screwed joints.

A camshaft adjuster is known from DE 195 29 277 A1, for example. The camshaft adjuster has a drive output element which is arranged so as to be rotatable relative to a drive input element. The drive input element is in drive connection with the crankshaft, and the drive output element is connected to the camshaft for conjoint rotation. The drive output element and the drive input element delimit a pressure space, which is divided into two oppositely acting pressure chambers by means of an axially movable piston. The piston is moved within the pressure space by supplying pressure medium to or discharging pressure medium from the pressure chambers. The piston has helical toothing, which meshes with helical toothing on the camshaft. Through one axial movement of the piston, it is thus possible to bring about a specific rotation of the camshaft relative to the crankshaft.

Moreover, a pressure accumulator is provided, which is arranged in a crankcase or a cylinder head of the internal combustion engine. During normal operation of the internal combustion engine, the pressure accumulator is filled with pressure medium, generally engine oil, by a pressure medium pump of the internal combustion engine. If the system pressure supplied by the pressure medium pump falls below a value required for functionally reliable operation of the camshaft adjuster, the pressure accumulator can be discharged into the pressure medium circuit of the internal combustion engine. It is thus possible to compensate for short-term undershooting of the minimum pressure within the pressure medium system and to increase the volume flow.

Another camshaft adjuster is known from EP 0 806 550 A1. This camshaft adjuster is in the form of a vane wheel, which has pressure medium distributor that is likewise assisted by a pressure accumulator. In this embodiment, the pressure accumulator is supposed to urge the camshaft adjuster into a phase position in which the internal combustion engine can be reliably restarted after having been switched off.

It is furthermore possible to prevent a dip in the speed of adjustment during the adjusting process. At the beginning of a phase adjustment operation, a certain quantity of pressure medium is taken from the pressure medium system of the internal combustion engine. As a result, the system pressure falls to a lower level. The system pressure present before the adjustment is not fully available for phase adjustment. The speed of phase adjustment and hence the performance of the internal combustion engine as a whole thus falls. If the pressure accumulator has been filled, this pressure drop is compensated by said accumulator and the speed of adjustment is maintained at a high level.

SUMMARY OF THE INVENTION

The present invention relates to a camshaft adjuster which has an advantageously arranged pressure accumulator.

According to the present invention, the camshaft adjuster comprises a stator, a rotor and a pressure accumulator. The rotor and the stator can be turned relative to one another. The rotor and the stator have a plurality of radially oriented vanes, and the vanes form oppositely acting working chambers, which can be supplied with hydraulic medium in order to turn the rotor relative to the stator. The pressure accumulator, which is intended for pressurized storage of hydraulic medium, has a control vane. A vane of the rotor or of the stator (projects around the control vane.

In one embodiment of the invention, the pressure accumulator has a pressure accumulator housing, a pressure accumulator spring, a pressure accumulator piston and one or more control vanes. The pressure accumulator housing is designed as a component of U-shaped cross-section. The pressure accumulator piston is situated therein in an axially movable manner in the form of an annular disk. The pressure accumulator piston can be fitted coaxially through the remaining open side. In this arrangement, the pressure accumulator piston has a groove to accommodate sealing means (e.g., sealing rings) on the inner and outer circumference. The pressure accumulator piston thus divides the pressure accumulator housing into two chambers which are sealed relative to one another, the spring space and the pressure chamber. Arranged in the spring space is the pressure accumulator spring, which acts with the pressure accumulator piston against a hydraulic medium pressure in the pressure chamber. To generate the pressure in the pressure chamber, hydraulic medium is introduced through pressure accumulator openings arranged in the pressure accumulator housing, thereby preloading the pressure accumulator spring. To store the pressure in the pressure accumulator, the pressure accumulator openings are closed. At the desired operating point of the camshaft adjuster, the stored pressure can be released back into the camshaft adjuster, specifically into the working chambers, via the pressure accumulator openings and thus assists the operation of the camshaft adjuster when there is a lack of hydraulic medium.

The pressure accumulator openings are arranged alternately with respect to the control vanes. The control vanes are, in turn, delimited by the wall of the vane in the rotor. By means of the movement of the control vane relative to the rotor vane, the pressure accumulator opening is moved into or out of overlap with the hub of the rotor. By means of the hub or the inside diameter thereof, the pressure accumulator or pressure accumulator housing is accommodated with its outside diameter and arranged concentrically therewith. The concentricity is advantageous here because the radial ends of the control vanes must act in a sealing manner with the rotor vanes during their relative movement. The pressure accumulator spring, which is designed as a compression spring, is thus likewise positioned very largely concentrically with the arrangement.

The control vane controls the overlap between the pressure accumulator openings and the hub of the rotor. In this context, the hub can also be replaced by some other sleeve-type component which can turn relative to the pressure accumulator housing. When the pressure accumulator is charged or when the external hydraulic medium pressure is lacking, the control vane must close the pressure accumulator openings without the influence of the external hydraulic medium pressure. This is achieved by control spring means which move the control vane into a rest position which closes the pressure accumulator openings. It is advantageous if this position is in the center of symmetry of the vane in which the control vane is situated.

These control spring means can be arranged directly between a control vane and a rotor vane, although arrangement on each control vane/rotor vane pair is also conceivable. This can be accomplished, for example, by leaf springs. As an alternative, it is also possible for a torsion spring arranged centrally with respect to the camshaft adjuster to move the control vane and hence the entire pressure accumulator into a rest position. In this case, there would be no impairment of the application of pressure to the control vane and the installation space would be optimized. As an alternative, is also possible to use a retention means to secure the control vane in a position.

In another embodiment of the invention, the control spring means is identical with the pressure accumulator spring. The pressure accumulator spring can operate both axially and circumferentially. For this purpose, an elongate hole is provided on the pressure accumulator housing for one spring end, which is arranged on the pressure-piston side. The hole allows for an axial movement of the spring end and permits a rotary motion of the pressure accumulator housing and the control vane.

For reliable operation, the control vanes must have a pressure surface which acts in the circumferential direction. For this purpose, the control vanes must be arranged with respect to the vane in such a way as to be very largely leaktight with respect to the hydraulic medium in order to ensure that there is no excessive leakage to impair functionality. For this purpose, spring-loaded and/or flexible sealing elements can be used to maintain the required leaktightness in operation. These elements can be formed integrally with or separately from the control vane or the vane.

The shape of the pressure surface of the control vane can be optimized for the flow of hydraulic medium. Thus, the surface can be arched, in the form of a turbine blade, radially straight or skewed relative to the radial and the axial direction.

In a further embodiment, the rotor is designed as a sheet-metal cup part, thereby rendering the accommodation of the pressure accumulator with its control vanes a particularly simple matter. The corresponding feed lines and openings can also be produced in a simple and economical manner by punching operations. The use of sheet-metal material can be extended to the production of the control vanes and to the production of the pressure accumulator housing and of the pressure accumulator piston. The control vanes can be fitted onto corresponding receptacles of the pressure accumulator housing as separately produced sheet-metal tabs. Integral construction is advantageous if leaks at the join between the control vane and the pressure accumulator housing need to be avoided or if the intention is to minimize the outlay required to ensure leaktightness.

In yet another embodiment, openings which allow inflow or outflow of hydraulic medium (e.g. engine oil) are machined into the rotor or vane walls. These openings are arranged in the vane walls that lie opposite in the circumferential direction. The number of openings can exceed the two opposite openings that are functionally required in one vane of the rotor in order to optimize inflow and outflow to and from the vane, for example. Thus, a plurality of openings can be provided in the circumferential direction on one side of the vane.

When a working chamber A is supplied with hydraulic medium, the hydraulic medium passes through these openings into the vane of the rotor and pushes the control vane out of the rest position thereof, the latter in turn turning the pressure accumulator housing relative to the rotor and thus exposing the pressure accumulator opening assigned to working chamber A. The pressure of the hydraulic medium when the engine is started is low but sufficient to move the control vane counter to the control spring means. Hydraulic medium now enters the pressure space and preloads the pressure accumulator spring slightly. In the meantime, the pressure of the hydraulic medium continues to rise with the speed of the engine, and the rotor is now turned relative to the stator. During the turning operation, the pressure chamber continues to be filled with hydraulic medium, and the rising pressure of the hydraulic medium furthermore ensures a deflection of the pressure accumulator spring. Once the adjusting process is complete, the hydraulic medium feed line to working chamber A is shut off from the engine pump, and the control vane is moved into its rest position by the control spring means, with the pressure accumulator openings being closed again. The position of the rotor relative to the stator can be secured by means of a locking mechanism to ensure that the falling pressure of the hydraulic medium in working chamber A does not cause a reverse rotation. The volume of hydraulic medium in the pressure chamber is now preloaded by the pressure accumulator spring, and the pressure accumulator is charged.

The rotor is reset relative to the stator by supplying pressure to chamber B via the hydraulic medium channel b leading to working chamber B. In this way, the locking mechanism, if present, is unlocked and the pressure in working chamber B begins to rise. The control vane is deflected in the opposite direction to the previous one and opens the pressure accumulator openings on the opposite side of the control vane to working chamber B. The high pressure in the pressure accumulator can now be used to assist the rising pressure in working chamber B in order to accelerate the initiation of the adjusting process.

The charged pressure accumulator is advantageous when starting the engine in order to assist the as yet insufficient engine oil pressure. The pressure accumulator also assists adjustment in one direction of rotation during operation. Moreover, unwanted pressure peaks resulting from alternating cam torques deflect the control vane owing to the pressure peak in the working chamber and can thus escape into the pressure accumulator. In addition, recirculation from one working chamber into the other working chamber can take place through the pressure chamber of the pressure accumulator, thereby making it possible to set a controlled position of the rotor relative to the stator, given appropriate activation of a control valve for controlling the hydraulic medium flows.

In yet a further embodiment of the invention, the pressure accumulator with the pressure accumulator piston has at least one spacer which, in the unpressurized state (i.e., when the pressure accumulator is not charged) preloads the pressure accumulator spring and thus maintains a spacing in the working direction, defining a space into which the hydraulic medium can flow. This spacer can be designed as a nose or raised portion on the pressure accumulator piston, on the pressure accumulator housing or on both. Moreover, it is possible for a plurality of spacers to be distributed uniformly over the circumference.

The construction and operation of the pressure accumulator with the control vane can, of course, also be implemented on the stator and the vanes thereof, and the example of the rotor can be transferred to the stator.

BRIEF DESCRIPTION OF THE. DRAWINGS

Embodiments of the invention are illustrated in the figures, in which.

DETAILED DESCRIPTION OF THE DRAWINGS

Figure 1:
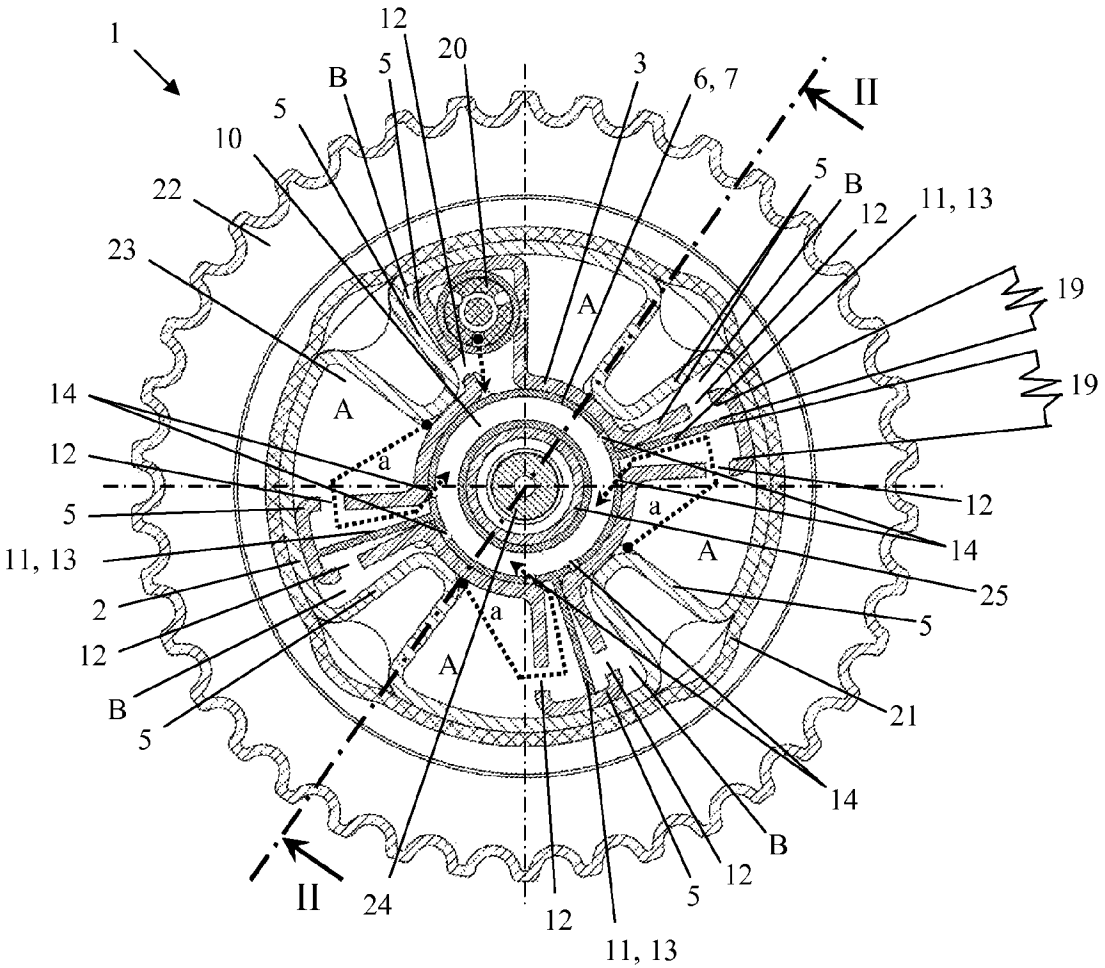
FIG. 1 shows a cross-section through a camshaft adjuster in one stop position.

FIG. 1 shows a camshaft adjuster 1 in a cross-section looking toward the working chambers A and B. The camshaft adjuster 1 consists of a drive wheel 22, a stator 2, a rotor 3, a covering cap 21, a disk 23, a locking mechanism 20, a pressure accumulator 6 and an adapter part 25. A central screw 24 with a concentrically arranged vent hole known from the prior art can furthermore be seen. The central screw 24 fastens the camshaft adjuster 1 on a camshaft end 26. The drive wheel 22, the covering cap 21, the stator 2, the rotor 3, the adapter part 25 and the pressure accumulator 6 are arranged concentrically with one another and with the axis of rotation 4 of the camshaft adjuster 1. The pressure accumulator 6 has control vanes 11 having control spring means 19 which, when not subjected to pressure (i.e., in the rest position or in the starting position of the camshaft adjuster 1) remain in a central position relative to the vane 5 of the rotor 3. The axis of rotation 4 of the camshaft adjuster 1 is perpendicular to the plane of the drawing and at the point of intersection of the central cross. The central screw 24 of the camshaft adjuster 1 is likewise arranged concentrically with the camshaft end 26, as known in the prior art.

If working chamber A is now subjected to pressure by a hydraulic medium feed, which is provided but not shown, the rotor 3 turns anticlockwise relative to the stator 2. In this arrangement, the stator 3, the drive wheel 22, the covering cap 21, the disk 23, the adapter part 25 and a closure part 28 (visible in FIG. 2) are designed to be fixed in terms of rotation relative to one another, and this assembly is secured axially by joining the adapter part 25 and the closure part 28. The overall assembly is driven by the crankshaft via the drive wheel 22, using traction means known in the prior art. The limited angular range is defined by the arrangement of vanes 5 on the stator 2 and on the rotor 3, which extend radially and define oppositely acting working chambers A, B, which are very largely leaktight with respect to the hydraulic medium. The construction and operation of the camshaft adjuster 1 can be obtained from the prior-art vane cell adjusters and are sufficiently well known to a person skilled in the art, and therefore it is the differences with respect to the prior art and the operation of the invention which will be explored further herein below.

When the hydraulic medium supply for working chamber A is subjected to pressure, hydraulic medium passes along hydraulic medium path a into working chamber A and through the openings 12 into the vane 5 of the rotor 3. There, the control vane 11 is actuated against the control spring means 19. The control vane 11 and the pressure accumulator housing 7 turn relative to the rotor 3 within a limited angular range, thus exposing a pressure accumulator opening 14 between the pressure accumulator housing 7 and the rotor 3. Once this pressure accumulator opening 14 is open, the hydraulic medium flows through the pressure accumulator opening 14 into the pressure accumulator chamber 10. Simultaneously with the opening process, the pressure accumulator opening 14 situated on the opposite side of the control vane 11 is closed. The control vane 11 is now in stop contact within the vane 5 of the rotor 3. The rotor 3 is now adjusted anticlockwise relative to the stator 2 and the pressure accumulator chamber 10 is simultaneously filled. Adjustment is complete when one vane 5 of the rotor 3 is in stop contact with a complementary vane 5 of the stator 2. Here, one vane 5 of the rotor 3 is fitted with the locking mechanism 20. The locking mechanism 20 is locked when unpressurized and, in this stop position of the stator 2, latches with the rotor 2. During the adjustment, the hydraulic medium channel b has been opened toward the tank in accordance with the known oil-pressure-actuating principle. This has allowed excess hydraulic medium to be discharged from the locking mechanism via the hydraulic medium channel B.

Figure 2:
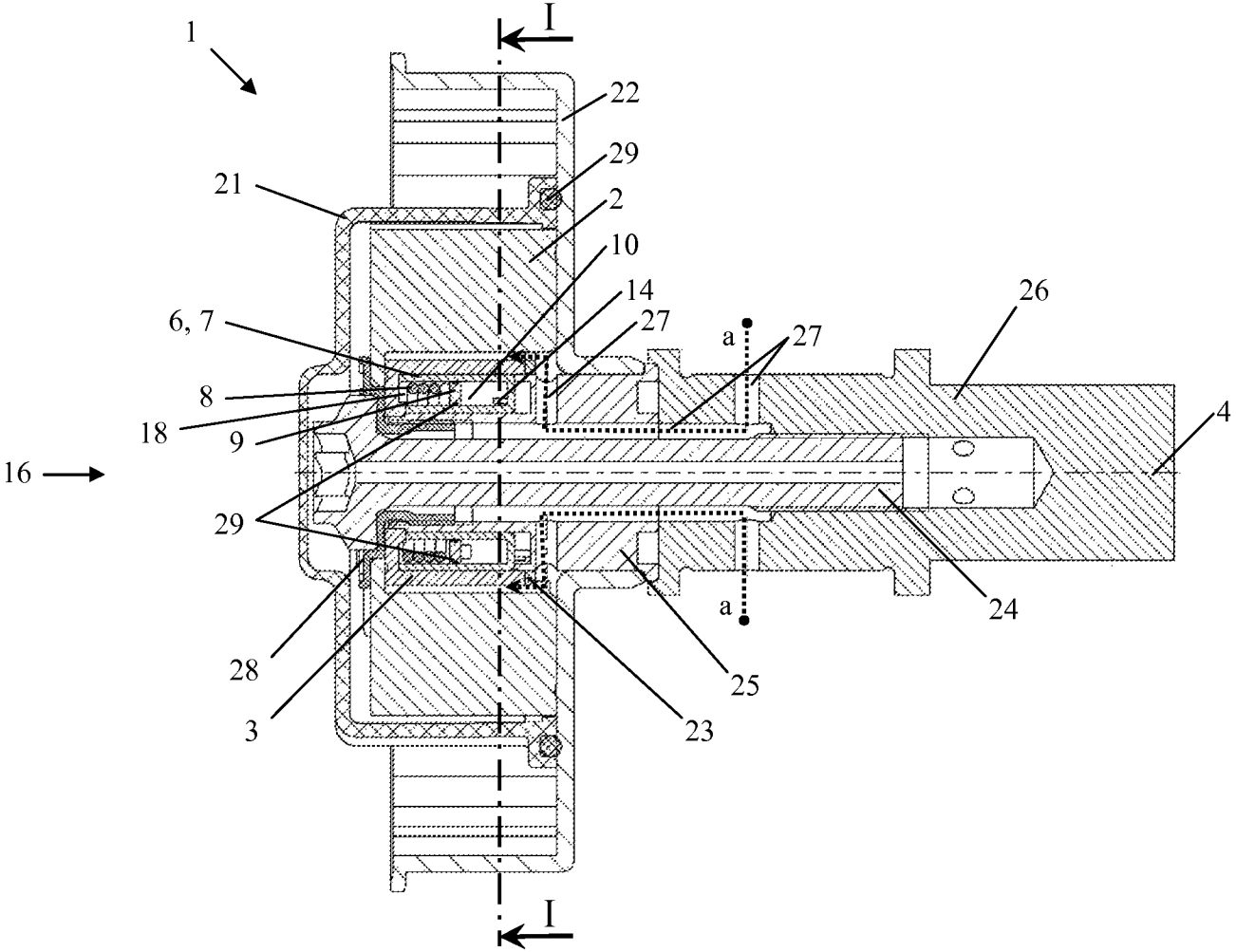
FIG. 2 shows a longitudinal section I-I from FIG. 1.

FIG. 2 shows a longitudinal section I-I from FIG. 1 to illustrate the path along the hydraulic medium channel a and the operation of the pressure accumulator 6. The hydraulic medium is fed in via a camshaft bearing of the camshaft end 26, via radial holes 27, into the socket for the central screw 24. Via a passage formed by the radial gap between the central screw 24 and the camshaft end 25 and adapter part 25, the hydraulic medium enters a radial hole 27 in the adapter part 25 and is directed into working chamber A. The onward path is represented schematically in FIG. 1 by the dashed arrow.

The hydraulic medium which enters the pressure accumulator chamber 10 through the pressure accumulator openings 14 preloads the pressure accumulator spring 8 by means of the pressure accumulator piston 9. The pressure accumulator 6 is now charged.

Figure 3:
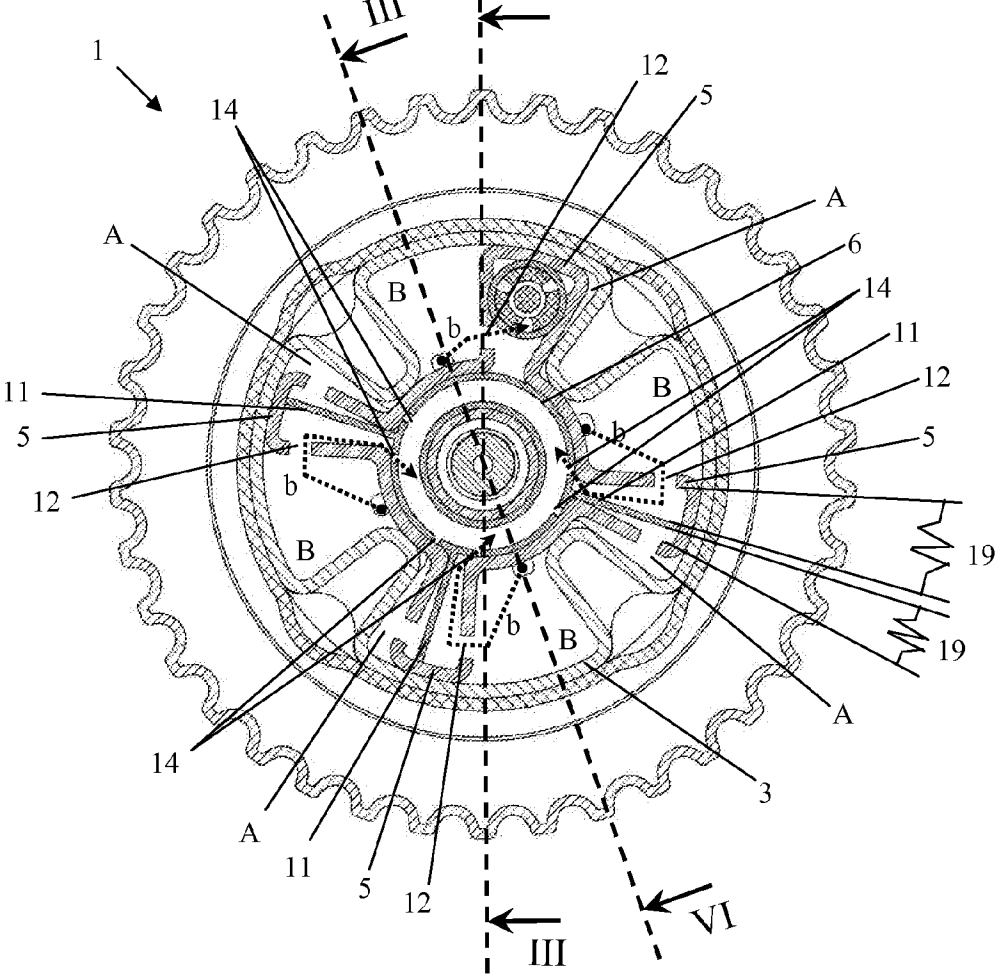
FIG. 3 shows a cross-section through the camshaft adjuster in the other stop position.

FIG. 3 shows a cross-section through the camshaft adjuster 1 in the other stop position, the adjusting process in the clockwise direction having been completed. In the initial position shown in FIG. 1 and with the pressure accumulator 6 charged, hydraulic channel b is now subjected to pressure and hydraulic channel a is opened toward the tank. Via the feed line to working chamber B, hydraulic medium once again passes through working chamber B, via the openings 12, into the interior of the vane 5. Here, the pressure of the hydraulic medium acts on the control vane 11 from the opposite side to that during anticlockwise adjustment. In this case, the control vane 11 is now initially adjusted in the vane 5 in the clockwise direction until it is in stop contact in the vane 5. In this case, the pressure accumulator openings 14 leading to working chamber A are closed, and the pressure accumulator openings 14 leading to working chamber B are opened. The preloaded pressure accumulator spring 8 enables the charged pressure accumulator 6 to release the previously enclosed volume of hydraulic medium again and allow it to flow into working chamber B. It is apparent that even relatively small quantities of hydraulic medium can adjust the control vane 11 when they reach working chambers A or B, even before the pressure of the hydraulic medium is sufficient to move the rotor 3. The charged pressure accumulator 6 assists the adjustment of the rotor 3 when the engine is being started or there is an inadequate supply of hydraulic medium.

Figure 4:
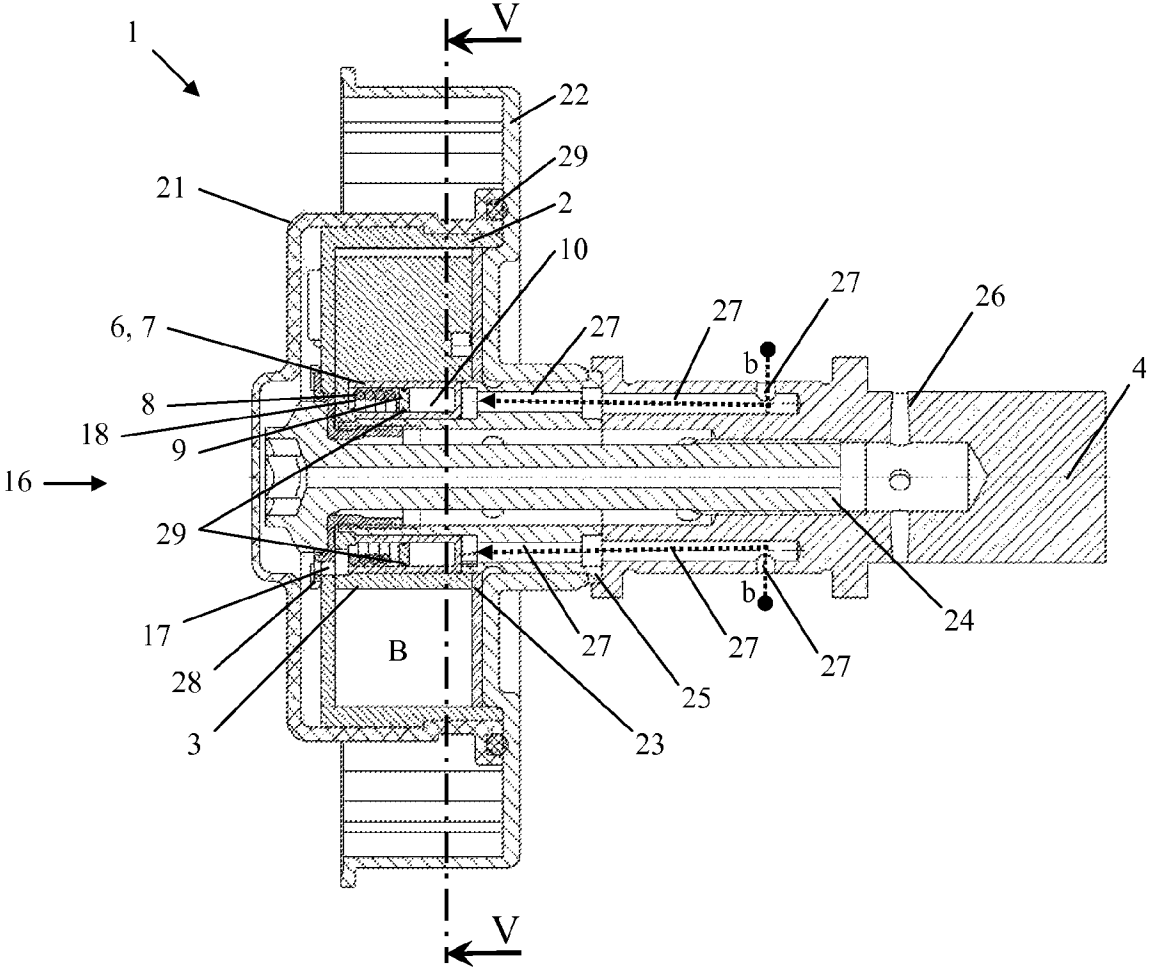
FIG. 4 shows a longitudinal section III-III from FIG. 3.

FIG. 4 shows a longitudinal section III-III from FIG. 3 to illustrate the path along hydraulic medium channel b. Via another radial hole 27, hydraulic medium is directed out of the camshaft bearing of the camshaft end 26 into a hole 27 running parallel to the axis of rotation 4, into an aligned hole 27 in the adapter part 25. This hydraulic medium initially collects in a chamber delimited by the adapter part 25, the pressure accumulator housing 7 and the rotor 3. However, the disk 23 has depressions or wall thickness reductions which, together with the rotor 3, form an inlet into working chamber B (see FIG. 5). The vent 17 for the spring space 18 can furthermore be seen. The vent 17 is formed by holes axially parallel to the axis of rotation 4 and carries foreign matter out of the spring space 18 during operation. The axis-parallel holes of the vent 17 are arranged in such a way in the rotor 3, in the stator 2 and in the closure part 28 that an opening cross-section formed between them remains. One ideal option is for the axis-parallel holes of the vent 17 to be arranged in alignment.

Figure 5:
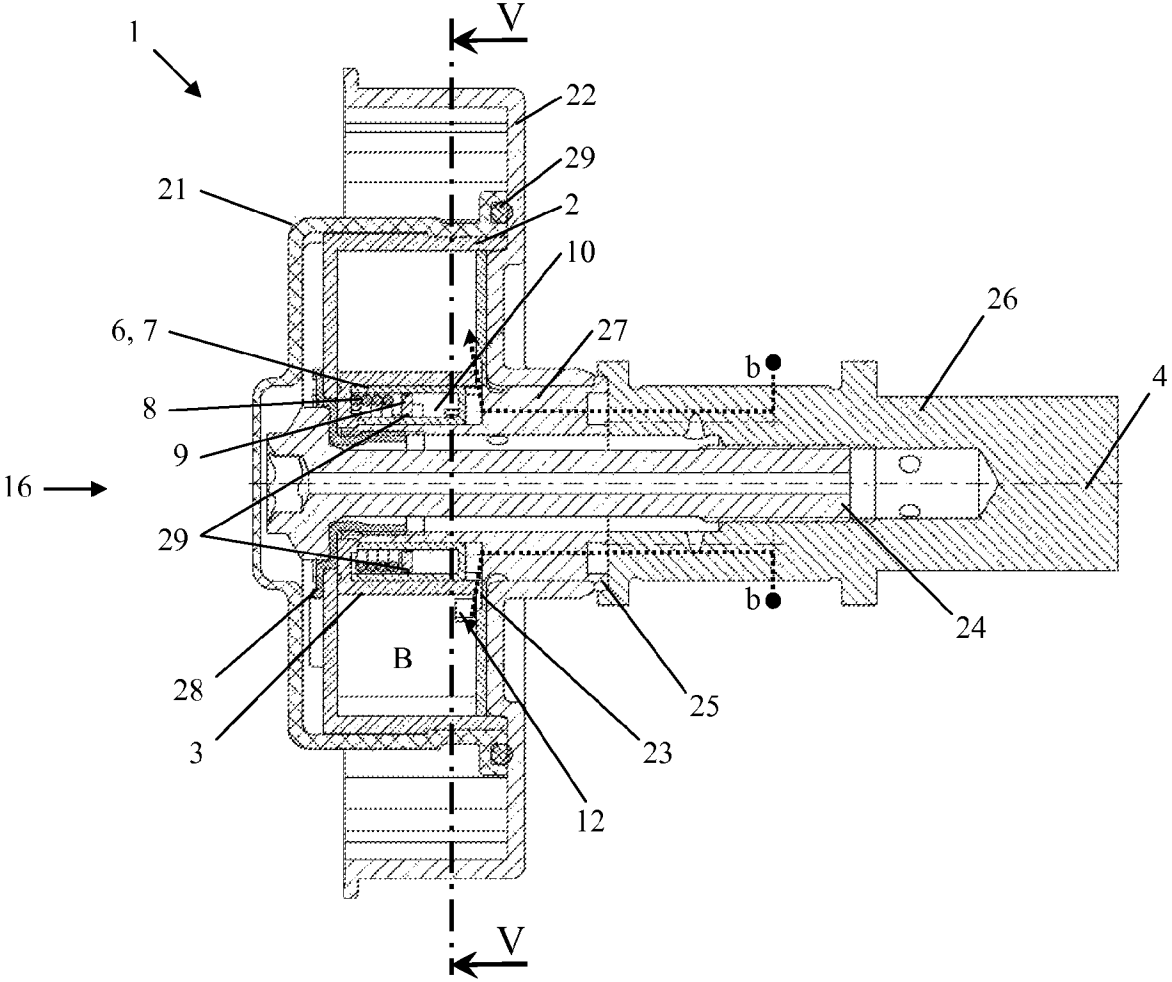
FIG. 5 shows a longitudinal section II-II from FIG. 3.

FIG. 5 shows a longitudinal section III-III from FIG. 3 to further illustrate hydraulic medium path b. Here, it is possible to see the holes 27 parallel to the axis of rotation 4 which are mentioned in FIG. 4. A view of the design of the inlet for hydraulic medium through the openings 12 in the rotor 3 is furthermore provided.

Figure 6:
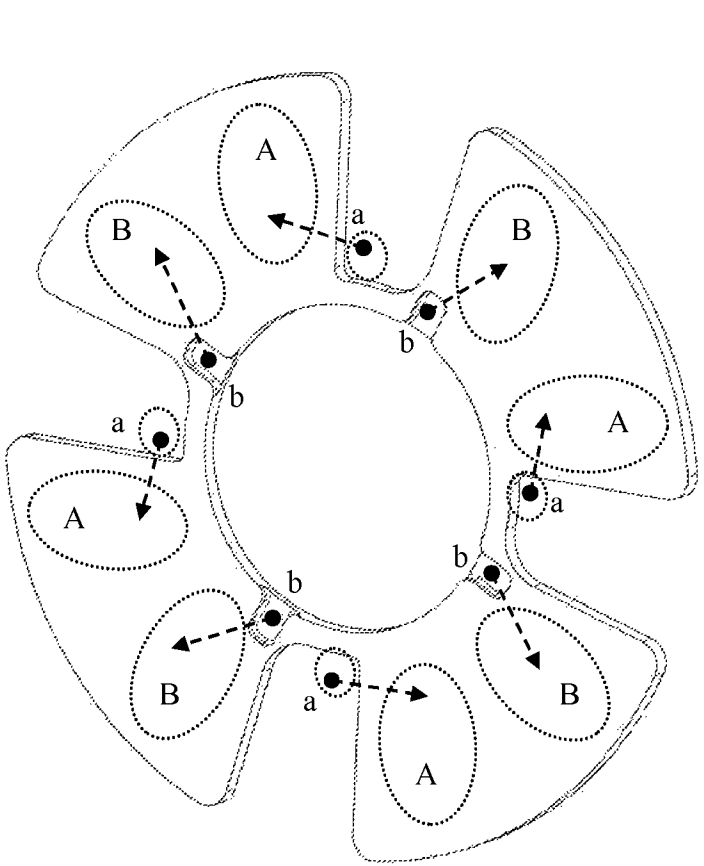
FIG. 6 shows an isometric view of a disk.

FIG. 6 shows an isometric view of the disk 23. Here, the inlets along the hydraulic medium channel a, b leading to the working chambers A, B are shown schematically, but without the peripheral components.

Figure 7:
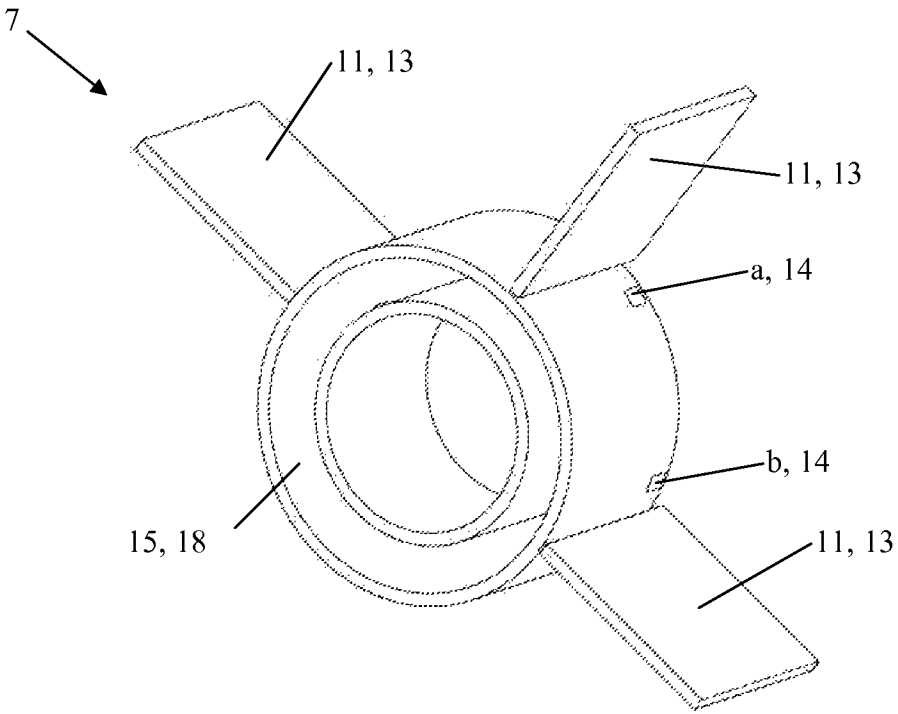
FIG. 7 shows an isometric view of an open side of a pressure accumulator housing.

FIG. 7 shows an isometric view of the open side 15 of the pressure accumulator housing 7. The control vanes 11, which extend radially as sheet-metal tabs 13, are arranged irregularly on the circumference. This irregularity results from the arrangement of the locking mechanism 20 in the rotor 3, with the vane 5 that has the locking mechanism 20 remaining unoccupied by a control vane 11 when the pressure accumulator housing 7 is joined to the rotor 3. If a locking mechanism 20 is not provided, the number of control vanes 11 may coincide with the number of vanes 5 in the rotor 3.

Figure 8:
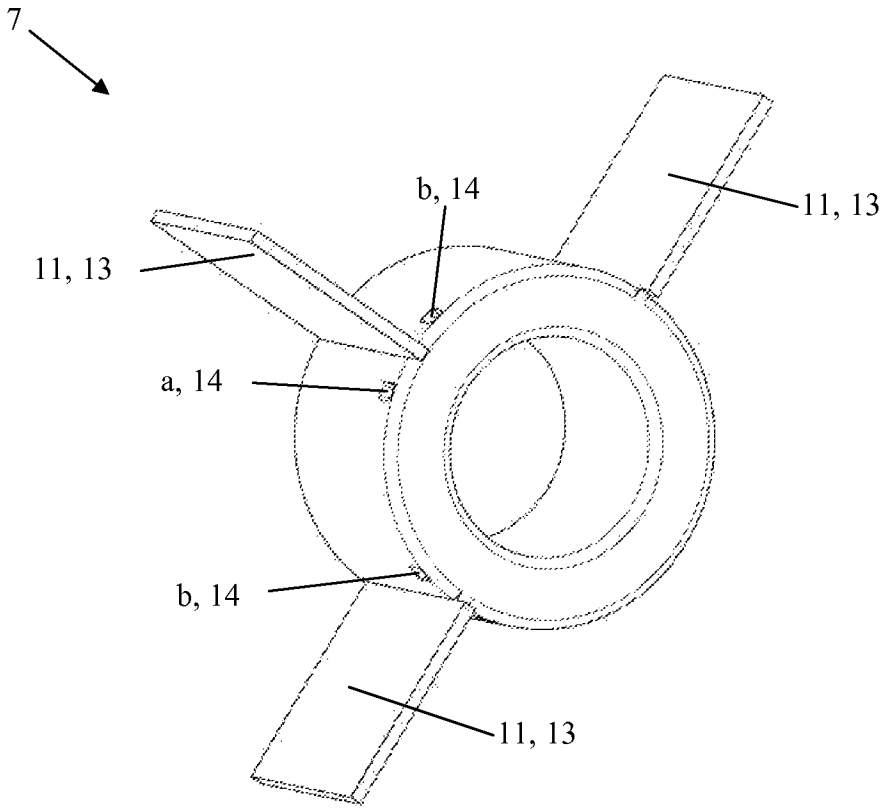
FIG. 8 shows an isometric view of an opposite side of a pressure accumulator housing.

FIG. 8 shows an isometric view of the opposite side of the pressure accumulator housing 7. The pressure accumulator openings 14 for the respective hydraulic paths a, b, which are arranged alternately on the control vanes 11, can be seen. In this case, the pressure accumulator openings 14 can have any desired cross-sectional shape (e.g., square, round, oval etc.), which is helpful for adjustment of the flow. The pressure accumulator housing 7 is advantageously designed as a sheet-metal part and is completed economically for mounting on the pressure accumulator housing by the control vanes 11 in the form of sheet-metal tabs.

Figure 9:
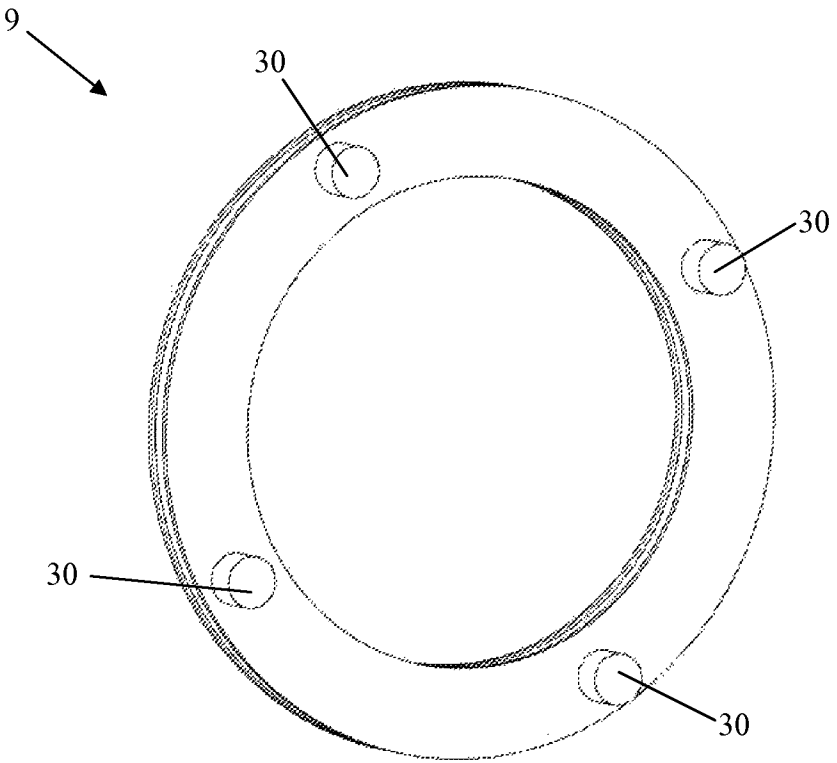
FIG. 9 shows an isometric view of a pressure accumulator piston.

FIG. 9 shows an isometric view of the pressure accumulator piston 9. Said piston has four spacers 30 distributed uniformly over the circumference and formed integrally with the pressure accumulator piston. The spacers 30 can have any desired shape appropriate for maintaining a minimum free space in the pressure accumulator chamber 10. A groove for the insertion of a sealing ring 29 is provided on the outside and on the inside diameter of the pressure accumulator piston 9 in order to seal off the pressure accumulator chamber 10 from the spring space 18.

List of Reference Signs

1. Camshaft adjuster
2. Stator
3. Rotor
4. Axis of Rotation
5. Vane
6. Pressure Accumulator
7. Pressure Accumulator Housing
8. Pressure Accumulator Spring
9. Pressure Accumulator Piston
10. Pressure Accumulator Chamber
11. Control Vane
12. Openings
13. Sheet-Metal Tab
14. Pressure Accumulator Opening
15. Open Side
16. Front Side
17. Vent
18. Spring Space
19. Control spring Means
20. Locking Mechanism
21. Covering Cap
22. Drive Wheel
23. Disk
24. Central Screw
25. Adapter Part
26. Camshaft End
27. Bore
28. Closure Part
29. Sealing Ring
30. Spacer A. Working Chamber A
B. Working Chamber B
C. Hydraulic Medium Path
D. Hydraulic Medium Path

What is claimed:

1. A camshaft adjuster, comprising:

a stator having a plurality of radially orientated vanes;

a rotor having a plurality of radially oriented vanes, the vanes of the rotor and the stator form oppositely acting working chambers, which can be supplied with a hydraulic medium in order to turn the rotor relative to the stator; and a pressure accumulator for pressurized storage of hydraulic medium, the pressure accumulator having a control vane that is separate from the radially oriented vanes of the stator and the radially oriented vanes of the rotor, wherein a vane of the rotor or the stator projects around the control vane so that the control vane extends into the vane of the rotor or stator.

2. The camshaft adjuster according to claim 1, further comprising a control spring that acts on the control vane so that the control vane rests in a central position relative to the vane of the rotor or the stator.

3. The camshaft adjuster according to claim 2, wherein the control spring is disposed in the pressure accumulator.

4. The camshaft adjuster according to claim 1, wherein the control vane is a sheet-metal tab extending in a radial direction.

5. The camshaft adjuster according to claim 1, wherein the vane projecting around the control vane has openings leading to the working chambers, the openings allow the hydraulic medium to reach the control vane from the working chambers.

6. The camshaft adjuster according to claim 1, wherein the pressure accumulator has a pressure accumulator opening, which is moved into an open or a closed position by the control vane.

7. The camshaft adjuster according to claim 1, wherein the pressure accumulator is formed integrally with the control vane.

8. The camshaft adjuster according to claim 1, wherein the pressure accumulator has a U-shaped profile in cross-section, an open side, which is oriented to face a front side of the camshaft adjuster, and a spring space that has a vent.

9. The camshaft adjuster according to claim 1, wherein the pressure accumulator has a pressure accumulator piston, a pressure accumulator housing and a pressure accumulator spring, one of the pressure accumulator piston and the pressure accumulator housing of the pressure accumulator having at least one spacer that preloads the pressure accumulator spring.

* * * * *